United States Patent [19]

Takada et al.

[11] 4,290,399

[45] Sep. 22, 1981

[54] FLOATLESS VARIABLE VENTURI TYPE CARBURETOR

[75] Inventors: Shigetaka Takada, Ohbu; Toshiharu Morino, Kuwana, both of Japan

[73] Assignee: Aisan Industry Co., Ltd., Aichi, Japan

[21] Appl. No.: 109,937

[22] Filed: Jan. 4, 1980

[30] Foreign Application Priority Data

Jun. 12, 1979 [JP] Japan ..... 54-73915

[51] Int. Cl.[3] ..... F02M 7/00; F02M 9/06; F02B 3/00

[52] U.S. Cl. ..... 123/439; 123/437; 261/44 C; 261/56; 261/69 A; 261/121 B

[58] Field of Search ..... 123/437, 438, 439, 440; 261/DIG. 44 C, DIG. 74, DIG. 121 B, DIG. 69 A, DIG. 56

[56] References Cited

U.S. PATENT DOCUMENTS

| | | | |
|---|---|---|---|
| 3,855,974 | 12/1974 | Mayer | 261/44 C |
| 3,963,009 | 6/1976 | Mennesson | 261/44 C |
| 4,036,186 | 7/1977 | Hattori et al. | 261/44 C |
| 4,060,064 | 11/1977 | Minami et al. | 261/44 C |
| 4,079,713 | 3/1978 | LaPrade et al. | 261/44 C |
| 4,083,338 | 4/1978 | Berthing et al. | 123/439 |
| 4,144,855 | 3/1979 | Masui et al. | 261/121 B |
| 4,167,547 | 9/1979 | Takamaru et al. | 123/439 |
| 4,173,956 | 11/1979 | Ikeura et al. | 261/121 B |
| 4,187,805 | 2/1980 | Abbey | 123/439 |

*Primary Examiner*—Charles J. Myhre
*Assistant Examiner*—R. A. Nelli

[57] ABSTRACT

A floatless variable venturi type carburetor in which the float chamber is substituted by a fuel pressure regulator. The carburetor has, in addition to the ordinary constituents such as variable orifice, fuel metering jet and air bleed, a fuel valve disposed in the fuel passage leading to the fuel metering jet and adapted to be opened and closed in relation to the turning on and off of the engine key switch, and a fuel pressure regulator adapted to regulate the pressure of the fuel introduced to the fuel metering jet through the fuel valve. The fuel pressure regulator has two regulating chambers, one of which being communicated with the inlet side of the fuel valve while the other being in communication with a venturi vacuum pickup port, so that the fuel pressure regulator maintains a constant pressure differential, by the action of a diaphragm separating two regulating chambers, between the fuel pressure at the inlet side of the fuel metering jet and the venturi vacuum. The fuel pressure regulator also is so constructed that its valve mechanism constitutes a part of a fuel return passage to a fuel tank. The carburetor is advantageously incorporated in a feedback system for controlling the air-fuel ratio of the mixture formed in the carburetor, the system having an exhaust gas sensor disposed in the exhaust system of the engine, a control circuit adapted to produce a control signal in response to the output from the exhaust gas sensor, and an actuator adapted to operate in response to the control signal, and means for varying the opening area of the air bleed in response to the operation of the actuator.

3 Claims, 6 Drawing Figures

FLOATLESS VARIABLE VENTURI TYPE CARBURETOR

BACKGROUND OF THE INVENTION

The present invention relates to an improvement in a variable venturi type carburetor and, more particularly, to a floatless variable venturi type carburetor having no float chamber.

Conventional variable venturi type carburetors have various problems originating from the float chamber. For instance, the size of the carburetor as a whole is inconveniently increased due to the provision of the float chamber. It is to be pointed out that a complicated and troublesome countermeasure is necessary against the undesirable enrichment of air-fuel mixture due to evaporation of the fuel which takes place when the ambient air temperature is high. Further, the air-fuel ratio of the mixture is inconveniently fluctuated due to a change in the fuel level in the float chamber attributable to a bounding of the chassis or turning of the automobile.

SUMMARY OF THE INVENTION

It is, therefore, an object of the invention to overcome the above described problems of the prior art by providing a floatless variable venturi type carburetor in which a fuel pressure regulator constituted by a diaphragm and associated members is used in place of the float chamber. This floatless variable venturi type carburetor offers various advantages. Firstly, the carburetor as a whole is made compact. Secondly, undesirable invasion of the carburetor by the evaporated fuel is avoided. Thirdly, it becomes possible to atomize the fuel by an air flow of a high flowing velocity. Further, according to the invention, a mixture control is effected by a feedback system incorporating an exhaust gas sensor.

More specifically, according to the invention, there is provided a variable venturi type carburetor in which the fuel is metered by a fuel metering jet associated with a variable venturi adapted to change the opening area of the venturi section substantially in proportion to the flow rate of the air flowing through the venturi section, and the metered fuel is discharged into the venturi section through a fuel discharge port, characterized by comprising a fuel valve disposed in the fuel passage and communicated at its outlet side with the fuel metering jet, a fuel pressure regulator adapted to regulate the pressure of the fuel introduced to the fuel metering jet through the fuel valve which is adapted to be opened and closed in response to the operation of the key switch of the engine, the fuel regulator including two regulator chambers defined by a diaphragm, one of the regulating chambers being communicated with the inlet side of the fuel valve which the other regulator chamber being in communication with a venturi pressure pickup port such that the pressure differential between the inlet portion of the fuel metering jet and the venturi section will remain constant, the pressure regulator being so constructed that its valve mechanism constitutes a part of a return passage to the fuel tank.

The other objects and advantageous features of the invention will become more clear from the following description of the preferred embodiments taken in conjunction with the accompanying drawings.

DESCRIPTION OF THE PREFERRED EMBODIMENTS

Before turning to the description of the preferred embodiments, a description will be made hereinunder as to a conventional variable venturi type carburetor to clarify the drawbacks of the prior art, in order to facilitate the understanding of advantages of the invention.

Figure 1:
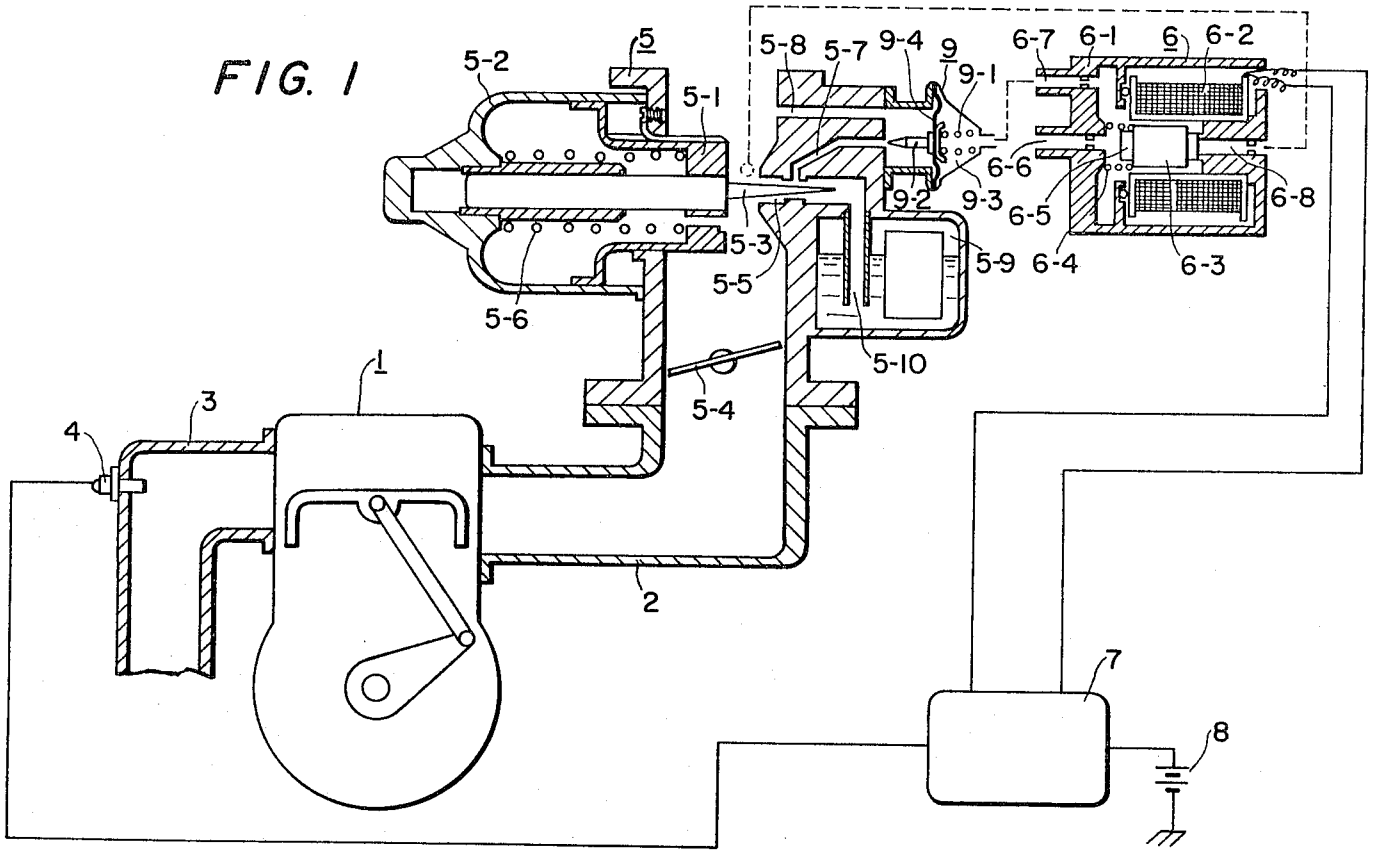
FIG. 1 is a partial longitudinal sectional view of a feedback system of a conventional variable venturi type carburetor.

Referring to FIG. 1 showing the feedback system having a conventional variable venturi type carburetor, an exhaust gas sensor 4 is adapted to produce a signal representative of air-fuel ratio of the mixture. This signal is delivered to a control circuit 7 and is compared by the latter with a command air-fuel ratio. An electric control signal derived from the control circuit 7 is delivered to an actuator 6 which produces a controlling vacuum signal corresponding to the electric control signal. The controlling vacuum signal is then transmitted to a diaphragm 9-3 which is adapted to produce a displacement of a needle valve 9-2 by an amount corresponding to the level of the controlling vacuum signal. The needle valve 9-2 in turn varies the area of opening of an air bleed to increase and decrease the rate of discharge of fuel through a fuel nozzle 5—5, thereby to control the air-fuel ratio to conform the latter to the command air fuel ratio.

The conventional variable venturi type carburetor, however, involves the following problems, as stated before, due to the provision of a float chamber.

Namely, the size of the carburetor as a whole is increased inconveniently due to the provision of the float chamber. In addition, a complicated and troublesome countermeasure is required against the undesirable enrichment of the air-fuel mixture due to evaporation of fuel which takes takes place when the ambient air temperature is high. Further, the air-fuel ratio is made to fluctuate due to a change in the fuel level in the float chamber attributable to a bounding or turning of the vehicle.

It is remarkable that these problems of the prior art are fairly overcome by the floatless variable venturi type carburetor of the invention, as will be understood from the foregoing description of the preferred embodiments.

Figure 2:
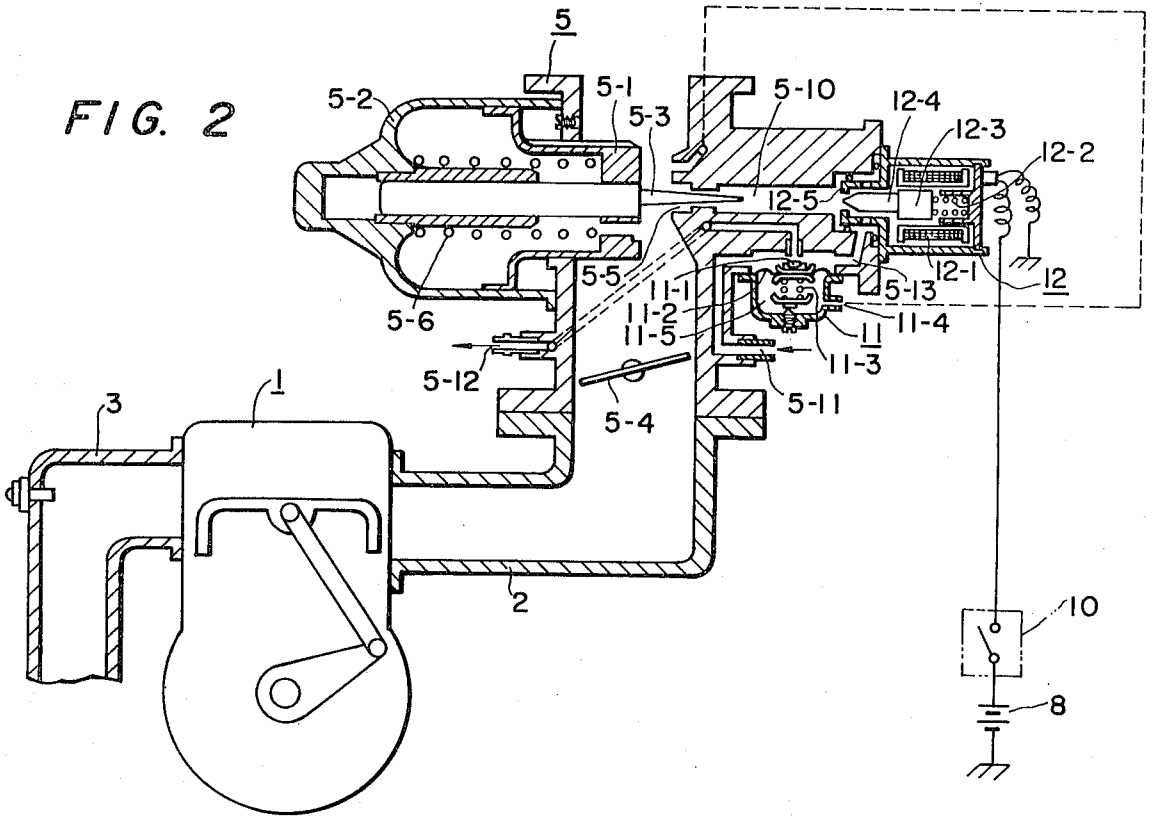
FIG. 2 is a sectional view of a floatless variable venturi type carburetor in accordance with the invention.
Figure 3:
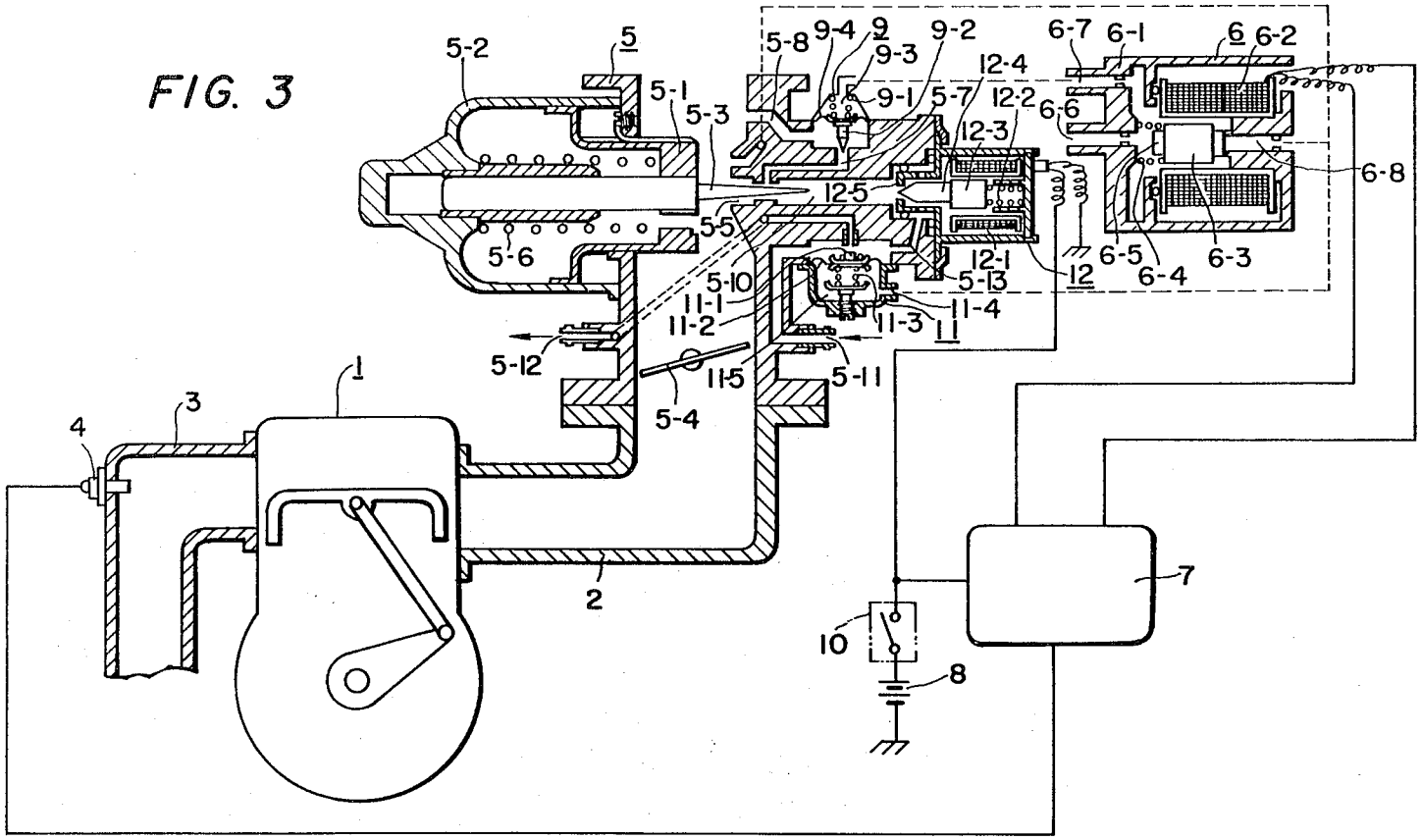
FIGS. 3 and 4 are partial longitudinal sectional views of a feedback system of a floatless variable venturi type carburetor in accordance with the invention.
Figure 4:
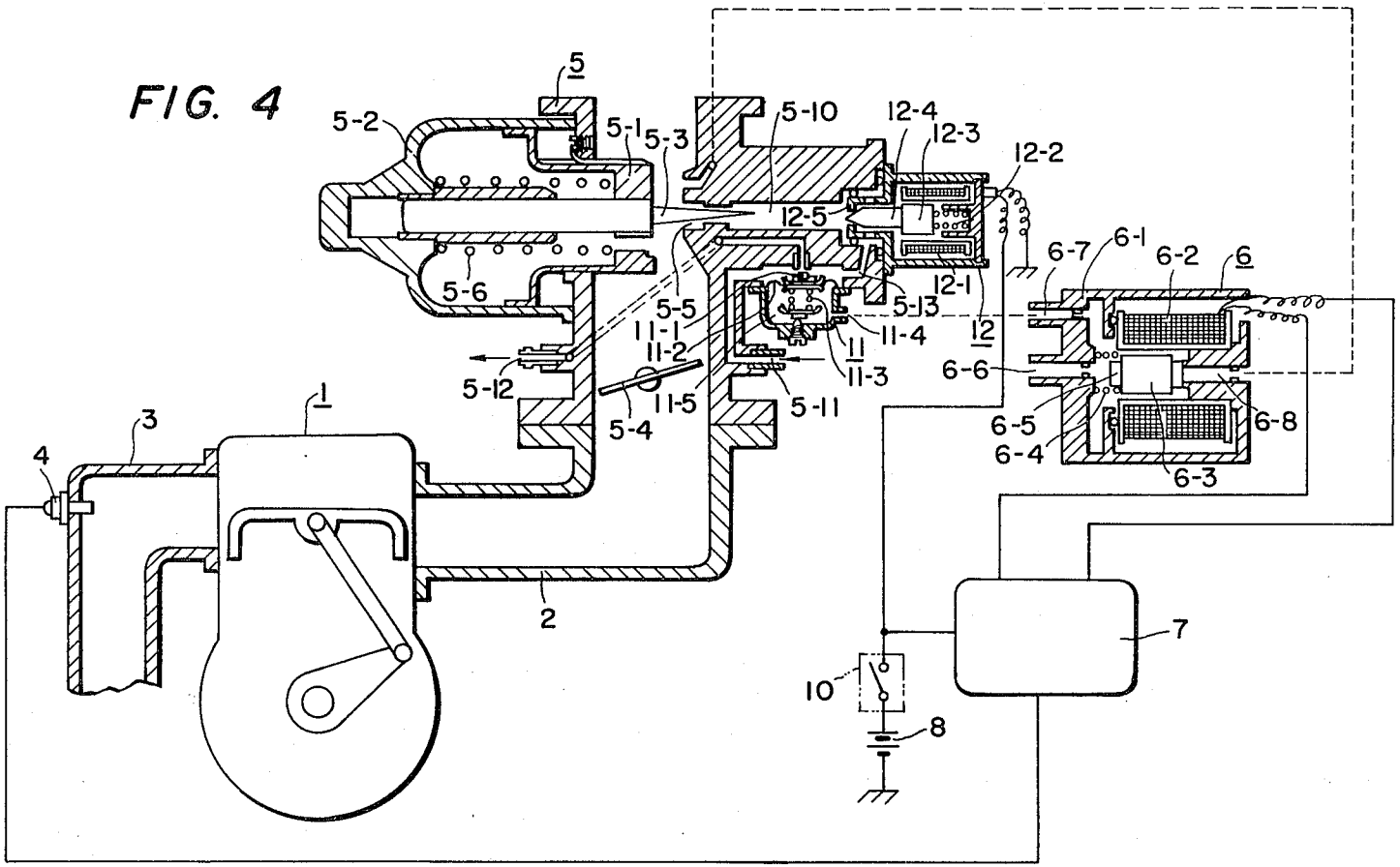
Figure 5:
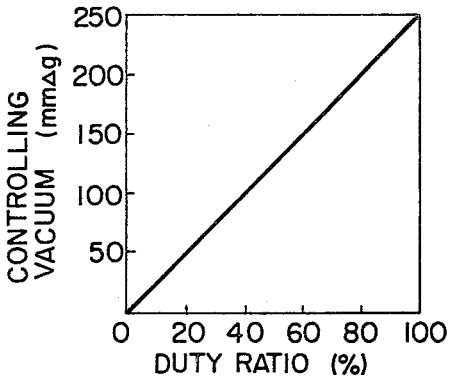
FIG. 5 is a chart showing the operation characteristic of an actuator.
Figure 6:
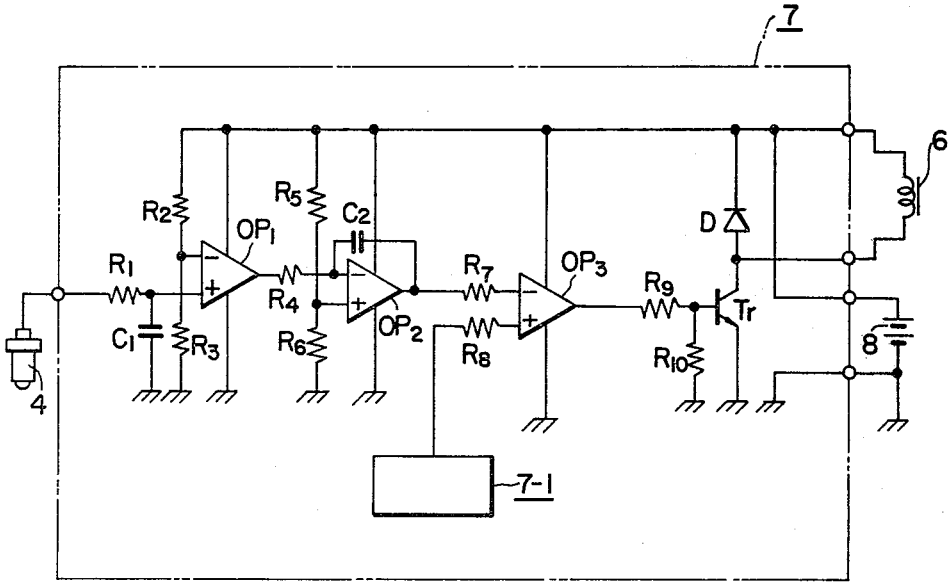
FIG. 6 shows an example of a control circuit.

FIG. 2 shows the construction of a floatless variable venturi type carburetor in accordance with the invention, while FIG. 3 shows a feedback system adapted for controlling the air-fuel ratio by changing the opening area of the air bleed making use of the floatless variable venturi type carburetor shown in FIG. 2. FIG. 4 shows a feedback system for controlling the air-fuel mixture through controlling the pressure in a regulator chamber. FIGS. 5 and 6 show, respectively, an example of an actuator used in the feedback system.

Referring to these FIGS., a reference numeral 1 denotes the body of an internal combustion engine having an intake manifold 2 and an exhaust manifold 3. A reference numeral 4 designates an exhaust gas sensor disposed in the exhaust system of the engine. A carburetor generally designated at a reference numeral 5 includes a variable venturi 5-1 housed by a housing 5-2, a needle valve 5-3, a throttle valve 5-4, a discharge port 5-5, a spring 5-6, an air-bleed passage 5-7, an air-bleed inlet passage 5-8, a fuel passage 5-10, a fuel inlet port 5-11, a fuel return port 5-12 and a fuel passage 5-13.

An actuator generally designated at a reference numeral 6 denotes a case 6-1, a coil body 6-2, a movable core 6-3, a spring 6-4, a valve 6-5, an atmospheric port 6-6, a control pressure port 6-7 and a pressure source port 6-8.

A reference numeral 7 denotes a control circuit which include an oscillator 7-1, resistors R1-R10, capacitors C1-C2, operation amplifiers OP1-OP3, diode D and a power transistor Tr.

An air-bleed controlling section generally denoted by a reference numeral 9 is constituted by a spring 9-1, a needle valve 9-2, a control pressure chamber 9-3 and a diaphragm 9-4.

A reference numeral 10 denotes a key switch for opening and closing the ignition electric circuit of the engine.

A fuel pressure regulator generally designated by a reference numeral 11 includes a valve 11-1, a diaphragm 11-2, a spring 11-3, a pressure introduction port 11-4 and a pressure chamber (regulator chamber) 11-5.

Finally, a solenoid-actuated fuel valve denoted generally by a reference numeral 12 includes a coil body 12-1, a spring 12-2, a movable core 12-3, a valve body 12-4 and a valve seat 12-5.

FIG. 2 shows the basic construction of a floatless variable venturi type carburetor of the invention. A constant pressure differential is maintained by the fuel pressure regulator 11 between the fuel pressure of the fuel supplied through the fuel inlet port 5-11 and the pressure in the venturi section. The fuel is then introduced, through the solenoid-actuated fuel valve 12 which is adapted to open and close in response to the turning on and off of the key switch 10, to the fuel nozzle 5-10. Then, the fuel is discharged through the fuel discharge port 5-5, at a rate which is metered by a cooperation of the metering needle 5-3 and the jet in proportion to the flow rate of the air flowing through the venturi 5-1.

The venturi 5 is adapted to be moved to the left as viewed in the drawings in proportion to the flow rate of the air passing by the venturi 5-1, to a position where the force of vacuum generated in the venturi section balances the force of the spring 5-6. In other words, the venturi 5-1 is so controlled by the force of the spring 5-6 as to provide a substantially constant flow velocity of air in the venturi section in response to the change of the flow rate of the air flowing through the venturi opening.

As a result, the needle valve 5-3 fixed to the venturi 5-1 makes the same movement to vary the area of opening of the jet in accordance with the flow rate of the air passing through the venturi section.

A substantially constant pressure differential is preserved between the discharge port 5-5 and the fuel passage 5-10, by the action of the fuel pressure regulator 11 which will be described later.

As the engine key switch 10 is turned on, the solenoid of the solenoid-actuated fuel valve 12 is energized to drive the valve 12-4 away from the valve seat 12-5 to open the fuel passage. Therefore, the fuel flows through the opening of the valve 12-4 of the fuel valve 12, and the fuel passage 5-10, and is finally discharged through the discharge port 5-5 after a metering effected by the cooperation of the metering needle 5-3 and the jet.

The diaphragm 11-2 of the fuel pressure regulator 11 separates two regulating chambers one of which is adapted to receive the fuel pressure while the other is adapted to be subjected to the venturi vacuum. The arrangement is such that the constant pressure differential is maintained between the fuel pressure in the fuel passage 5-13 and the venturi vacuum by the action of the diaphragm 11-2 which is adapted to be deflected by a balance between the force of the spring 11-3 and the difference between the pressures acting in both regulating chambers, i.e. between the fuel pressure and the venturi vacuum. More specifically, as the fuel pressure is increased, the valve 11-1 is moved downward to permit the surplus fuel to be relieved to a fuel tank (not shown) through the return passage 5-12. To the contrary, as the fuel pressure is lowered, the valve 11-1 is moved upward to reduce the returning flow of the fuel, thereby to recover the original fuel pressure.

The fuel is then mixed with the air in the venturi section to form an air-fuel mixture which is supplied to the engine 1 through the intake manifold 2 after a metering effected by the throttle valve 5-4.

FIG. 3 shows a feedback system for controlling the air-fuel ratio, incorporating the floatless variable venturi type carburetor of the invention. The exhaust gas sensor 4 is adapted to produce a signal representative of the air-fuel ratio of the intake mixture. This signal is delivered to the control circuit 7 and is compared with a signal representative of a command air-fuel ratio. An electric control signal derived from the control circuit is transmitted to the actuator 6 which produces a control pressure corresponding to the level of the electric control signal. The control pressure is transmitted to the diaphragm chamber 9-3 which in turn drives the needle valve 9-2.

Thus, the area of the air-bleed opening to the jet is controlled to increase and decrease the rate of fuel discharge through the discharge port 5-5, so that the air-fuel ratio of the intake mixture formed in the carburetor is controlled in accordance with the signal derived from the exhaust gas sensor 4 to conform the command air-fuel ratio.

Namely, the air-fuel ratio of the intake mixture is converted into an electric signal by the exhaust gas sensor sensitive to the contents of the gas contained by the exhaust gas. This electric signal is compared with the electric signal representative of the command air-fuel ratio by the control circuit 7 whose output is transmitted to the actuator 6 which in turn supplies a control pressure to the pressure chamber 9-3 of the diaphragm device for controlling the air-bleed, thereby to drive the needle valve 9-2 up and down as viewed in the drawing. The fuel flow rate will increase and decrease as the flow rate of the bleed air is decreased and increased, respectively. In consequence, the flow rate of the fuel is controlled in accordance with the signal derived from the exhaust gas sensor so as to make the air-fuel ratio conform the command air-fuel ratio.

FIG. 4 shows another feedback system in which, insteadly of controlling the opening area of the air bleed shown in FIG. 3, the pressure in the regulator chamber 11-5 of the fuel pressure regulator 11 is controlled through the action of the actuator 6 thereby to control the pressure differential between the venturi vacuum and the fuel pressure to control the flow rate of the fuel discharged from the discharge port 5-5, whereby the air-fuel ratio of the mixture is controlled to conform the command air-fuel ratio in accordance with the signal derived from the exhaust gas sensor 4.

A solenoid-actuated valve type actuator as shown in FIGS. 3 and 4 will be described by way of reference.

As electric current is supplied to the coil 6-2 of the actuator 6, an electromagnetic force is generated to displace the movable core 6-3 to the left to close the atmospheric port 6-6. To the contrary, as the coil 6-2 is de-energized, the movable core 6-3 is moved to the right by the force of the spring 6-3 thereby to close the pressure source port 6-8. Thus, as the coil 6-2 is energized and de-energized, the movable core 6-3 is moved to the left and right so that the valve 6-5 fully opens the atmospheric port 6-6 and the pressure source port 6-8 repeatedly. It will be understood to those skilled in the art that the pressure at the control pressure port 6-7, i.e. the controlling vacuum is changed by changing the ratio of the time (duty ratio) between the period in which the coil is energized and the period in which the coil is de-energized. As seen from FIG. 5 showing the relationship between the duty ratio and the controlling vacuum, the controlling vacuum is increased as the duty ratio is increased.

The constant pressure obtained at the venturi section is introduced to the pressure source port 6-8.

Referring now to FIG. 6 showing an example of the control circuit, the signal derived from the exhaust gas sensor 4 is applied to the plus input terminal of the operation amplifier O01 through a low-pass filter constituted by a resistor R1 and the capacitor C1, and is compared with a command voltage (command air-fuel ratio) which is determined by a dividing resistors $R_2$ and $R_3$. The operation amplifier OP1 then produces an output signal "High" or "Low" in accordance with the result of the comparison. The output is then integrated by an integrator which is constituted by the resistor R4, capacitor C2 and the operation amplifier OP2. The output from the integrator, which is a signal varying in relation to time, is then compared with a signal of a comparatively high frequency obtained from an oscillator 7-1, and is subjected to a pulse-width modulation effected by the operation amplifier OP3. The output derived from the operation amplifier OP3 drives the solenoid-actuated valve which is the actuator 6, through the action of a power circuit constituted by the resistors R9,R10 and the transistor Tr.

Although the integrating control is made in the described example, this is not exclusive and a better result will be obtained by a proportional integrating control.

Also, the use of a solenoid-actuated valve as the actuator is not exclusive, and an equivalent effect is obtained by other type of actuator, e.g. an actuator constituted by a stepper motor or the like.

According to the invention, the problem concerning the interruption of fuel supply inherent in the conventional system incorporating a fixed venturi type carburetor is fairly avoided by the use of a variable-venturi type carburetor. In addition, the atomization of the fuel, as well as the mixing of the fuel with the air, is considerably improved to stabilize the combustion in the engine.

In addition to these advantages which are derived from the use of the variable-venturi type carburetor, the present invention offers the following advantages.

Namely, the carburetor as a whole is made compact and various advantage attributable to the use of the float chamber are overcome, thanks to the substitution of the fuel pressure regulator for the conventional float chamber. For instance, the treatment of an excessively rich air-fuel mixture, attributable to the evaporation of the fuel in the float chamber, is advantageously eliminated. Also, the problem caused by fluctuation of the fuel level in the float chamber is also eliminated. Further, due to the use of the variable venturi type carburetor which permits the use of an air flow of a high flowing velocity, the responsive characteristic of the system from the fuel discharge port 5-5 to the exhaust gas sensor 4 is improved considerably to diminish the delay of response in the feedback control system, thereby to ensure a better feedback control.

What is claimed is:

1. A variable venturi type carburetor in which fuel discharged to the venturi section of the carburetor is metered by a fuel metering jet which is constructed such that the opening area of the venturi section is changed substantially in proportion to the flow rate of the air flowing through the venturi section by a movement of a variable venturi, characterized by comprising: a fuel valve disposed in the fuel passage and communicated at its outlet side with said fuel metering jet, said fuel valve being adapted to be opened and closed in response to the turning on and off of the engine key switch; and a fuel pressure regulator adapted to regulate the pressure of the fuel introduced to said fuel metering jet through said fuel valve, said fuel pressure regulator having two regulating chambers defined by a diaphragm, one of said regulating chambers being communicated with the inlet side of the fuel valve while the other regulating chamber being in communication with a venturi vacuum pickup port such that said fuel pressure regulator effects a control to maintain a constant pressure differential between the fuel pressure at the inlet side of said fuel metering jet and said venturi vacuum, said fuel pressure regulator being so constructed that its valve mechanism constitutes a part of the fuel return passage to a fuel tank.

2. A variable venturi type carburetor in which fuel discharged to the venturi section of the carburetor is metered by a fuel metering jet which is constructed such that the opening area of the venturi section is changed substantially in proportion to the flow rate of the air flowing through the venturi section by a movement of a variable venturi, characterized by comprising: a fuel valve disposed in the fuel passage and communicated at its outlet side with said fuel metering jet, said fuel valve being adapted to be opened and closed in response to the turning on and off of the engine key switch; and a fuel pressure regulator adapted to regulate the pressure of the fuel introduced to said fuel metering jet through said fuel valve, said fuel pressure regulator having two regulating chambers defined by a diaphragm, one of said regulating chambers being communicated with the inlet side of said fuel valve while the other regulating chamber being in communication with a venturi vacuum pickup port such that said fuel pressure regulator effects a control to maintain a constant pressure differential between the fuel pressure at the inlet side of said fuel metering jet and said venturi vacuum, said fuel pressure regulator being so constructed that its valve mechanism constitutes a part of the fuel return passage to a fuel tank; an exhaust gas sensor disposed in the exhaust system of the engine; a control circuit adapted to produce a control signal in response to the output from said exhaust gas sensor; an actuator adapted to operate in response to said control signal; and means for varying the opening area of an air bleed passage provided in said fuel metering jet in accordance with the operation of said actuator, whereby the air-fuel ratio of the mixture is automatically controlled to conform to the command air-fuel ratio.

3. A variable venturi type carburetor in which fuel discharged to the venturi section of the carburetor is metered by a fuel metering jet which is constructed such that the opening area of the venturi section is changed substantially in proportion to the flow rate of the air flowing through the venturi section by a movement of a variable venturi, characterized by comprising: a fuel valve disposed in the fuel passage and communicated at its outlet side with said fuel metering jet, said fuel valve being adapted to be opened and closed in response to the turning on and off of the engine key switch; and a fuel pressure regulator adapted to regulate the pressure of the fuel introduced to said fuel metering jet through said fuel valve, said fuel pressure regulator having two regulating chambers defined by a diaphragm, one of said regulating chambers being communicated with the inlet side of said fuel valve while the other regulating chamber being in communication with a venturi vacuum pickup port such that said fuel pressure regulator effects a control to maintain a constant pressure differential between the fuel pressure at the inlet side of said fuel metering jet and said venturi vacuum, said fuel pressure regulator being so constructed that its valve mechanism constitutes a part of the fuel return passage to a fuel tank; an exhaust gas sensor disposed in the exhaust system of the engine; a control circuit adapted to produce a control signal in response to the output from said exhaust gas sensor; and an actuator which is adapted to operate in response to said control signal to produce a control pressure by modulating said venturi vacuum, said control pressure being delivered to said the other of said regulating chambers of said fuel pressure regulator; whereby the air-fuel ratio of the mixture is automatically controlled to conform to the command air-fuel ratio.

* * * * *